United States Patent [19]

Elbert et al.

[11] 4,049,428

[45] Sept. 20, 1977

[54] METAL POROUS ABRADABLE SEAL

[75] Inventors: Raymond John Elbert, Middleburg Heights; Ernest Gilbert Farrier, Parma, both of Ohio

[73] Assignee: Union Carbide Corporation, New York, N.Y.

[21] Appl. No.: 763,535

[22] Filed: Jan. 28, 1977

Related U.S. Application Data

[63] Continuation of Ser. No. 128,182, March 25, 1971, abandoned.

[51] Int. Cl.[2] ..... B22F 1/02; B22F 7/02

[52] U.S. Cl. ..... 75/208 R; 75/212; 75/221; 75/222

[58] Field of Search ..... 75/212, 221, 222, 208 R

[56] References Cited

U.S. PATENT DOCUMENTS

| | | | |
|---|---|---|---|
| 3,312,546 | 4/1967 | Mayer et al. | 75/208 X |
| 3,323,879 | 6/1967 | Kerstetter et al. | 75/201 X |
| 3,360,350 | 12/1967 | Sama | 75/208 R UX |
| 3,433,632 | 3/1969 | Elbert et al. | 75/208 CS |

FOREIGN PATENT DOCUMENTS

| | | | |
|---|---|---|---|
| 1,212,681 | 11/1970 | United Kingdom | 75/212 |

*Primary Examiner*—Leland A. Sebastian
*Attorney, Agent, or Firm*—J. Hart Evans

[57] ABSTRACT

A low density abradable seal produced by depositing metallic particles onto a binder coated substrate and then heat treating the coated substrate to produce a porous coating structure having excellent erosion and oxidation resistance and abradability characteristics.

10 Claims, No Drawings

METAL POROUS ABRADABLE SEAL

RELATED APPLICATIONS

This application is a continuation of our U.S. Patent application Ser. No. 128,182 filed Mar. 25, 1971, now abandoned.

FIELD OF THE INVENTION

This invention relates to a low density, porous metal structure, and process therefor, having ideal characteristics for abradable seal application.

DESCRIPTION OF PRIOR ART

There are many applications wherein a close clearance space is required between a moving member and a stationary member. For example, in designing turbines, a formidable problem is encountered when trying to minimize the clearance space between the turbine blade and the turbine housing. Although a close tolerance fit can be obtained by fabricating mating parts to within a close tolerance range, the expense required for such a fabrication process limits its use in commercial applications. In addition, when the mated assembly is exposed to a high temperature environment, the coefficient of expansion of the mating members may be different thus causing the clearance space to increase or decrease. The latter condition could result in a frictional contact between the members which in turn would cause a higher temperature to exist and thereby possibly damage one or both members. In the former condition, the increased clearance space in a turbine would permit gas to escape between the turbine blade tip and the housing thus leading to a decrease in efficiency since the escaping gas represented energy that has not been fully utilized.

Various coating techniques have been employed to coat the inside diameter of the turbine housing with an abradable coating which can be worn away by the frictional contact of the turbine blade thus providing a channel into which the blade tip can travel. Thus when subjecting the coated turbine assembly to a high temperature environment, the blade can expand or contract within the channel thereby preventing gas escape between the blade tip and inner diameter of the housing. This abradable coating technique for turbines not only increases the operating efficiency of the turbine but also provides a quick and inexpensive method for reservicing excessively worn turbines.

One method for applying an abradable metal coating, as outlined in U.S. Pat. No. 3,084,064, entails the plasma deposition of a metal coating onto a suitable substrate. Likewise, a coating of a homogeneous mixture of metal particles and a fugitive medium has been applied on substrates by various other techniques such as painting, spraying, etc. and even casting and molding techniques have been employed. Although these various methods produce an abradable coating usable for turbine applications and the like, they all have the disadvantage of providing a dense coating which is hard to chip off in small discrete amounts by friction contact so as to provide a well defined turbine tip channel having no large cavities through which the gas can escape. In addition, some of the above techniques involve expensive and cumbersome apparatus which makes them unsuited for use in commercial applications.

The present invention is intended to overcome the above drawbacks associated with abradable coating techniques and is directed to a simple coating process for applying a low density, porous metal coating that is admirably suited for abradable seal applications.

SUMMARY OF THE INVENTION

Broadly stated, the invention relates to a process of applying an abradable coating to the surface of a permanent or removable substrate, such as the inner diameter of the housing of a turbine. The process is mainly directed to the production of a low density, porous metal coating that is resistant to erosion and oxidation, and which can easily be abraded by surface contact friction in such a manner that essentially the surface that is contacted is worn away leaving a channel like passage. In turbine applications, the turbine blade will initially be out of contact with the abradable coated surface of the housing. However, as the temperature increases, within the turbine, the expanded rotating blade may contact and thus abrade a channel into the coated housing thereby providing an efficient seal therebetween which will minimize gas escape or leakage.

The abradable coating material has to be capable of being securely bonded to a substrate, withstand high temperature environments, abrade easily and only on the surface contacted and be resistant to erosion and oxidation in its intended environment. However, it is also within the purview of this invention to apply the abradable coating to a substrate which can be removed to yield a independent abradable porous structure. Metal coating materials such as nickel, chromium, and their alloys in any and all proportions are suitable for use as abradable coatings.

The process of this invention comprises the initial depositing of a binder material on a permanent or nonpermanent substrate to be coated. Suitable binders include thermoplastic or thermosetting resins, rubber band adhesives, or any other binder having a tacky characteristic when applied and then capable of being removed at elevated temperatures. The tacky binder coating should be at least 0.5 mil thick so as to secure any metal particles placed thereon, and preferably should be between about 1 mil and 3 mils thick.

The particles of at least one selected metal powder, such as a nickel-chromium alloy, are then deposited onto the tacky coated surface wherein they are secured. Any excess metal particles are then removed by conventional techniques such as shaking the assembly or by inverting it and letting gravity remove the excess. One or more additional particle embedded binder layers may be deposited on the substrate to produce a multilayer extended composite having a density not greater than 40 percent theoretical. If a higher density composite is desired, a cold rolling operation may be employed whereby the density can be increased to as high as 80 percent theoretical. The composite is then subjected to a heat treatment to sinter the metal, particles and to remove the binder thereby producing an extended porous metal structure having a density approximately equal to the density of the unheated composite and admirably suited for abradable seal applications since it will abrade in discrete fine particles under a small contact force. The particle size of the metal powder is somewhat variable with sixes between about 50 Tyler mesh and about 1 micron being desirable and sizes between about 100 Tyler mesh and about 150 Tyler mesh preferable.

The temperature and holding period for the heat treatment step is dependent on the metal particles selected and the binder employed. Once this selection has been made it is within the skill of a person schooled in the art to determine the temperature range and holding period necessary to sinter the metal particles and remove the binder. For example, using a rubber based binder and nickel chromium alloy particles, a heat treatment in a hydrogen atmosphere at above 1150° C at a maximum heatup rate of 30° C per minute and holding there for at least one hour and preferably two hours, will be sufficient for properly treating the coating. It is also possible to initially heat the coated structure to between about 1000° C to about 1200° C at a maximum rate of 30° C per minute and holding thereat for about 15 minutes so as to remove the binder. Thereafter the composite can be removed from the furnace for cleaning and sizing to a desired dimension. The binderless composite can then be heated again to above 1150° C for sintering of the metal particles.

Sprinkling metal particles onto a tacky binder layer and following thereafter with a sintering operation will produce a porous metal coating having a multitude of strong metal particle bonds while simultaneously exhibiting weak shear planes parallel to the coated surface. These characteristics make the coating admirably suited for abradable seal applications. In addition, the voids existing throughout the porous coating provide spaces into which segments of the sintered metal material can fill when the coated surface is subjected to a frictional contact force as encountered when a turbine blade tip contacts the inside coated diameter of the housing. The frictional contact force instead of actually causing all the extremities of the sintered metal particles to chip into segments, may also bend the extremeties of the metal-like columns into adjacent voids thus minimizing the presence of chipped or flaked particles in and around the clearance space between the stationary and moving components. The injection of severed or bent metal segments into voids in the porous coating along the contact surface area produces a densified coating surface in a channel like zone which minimizes gas leaks and escape passages thereat. Thus the low density, porous structure produced by the process of this invention is ideally suited for abradable seal applications since it minimizes chipping and flaking-off of the coated material which sometimes can result in the removal of excess material thereby creating gas escape passages.

When a porous metal abradable coating is intended for an environment that is highly inducive to oxidation, then the metal component of the coating should be selected for its oxidation resistance characteristics and the sintering operation should be performed in an inert or reducing atmosphere. To further increase the oxidation resistance of the abradable porous coating, a ceramic coating may be applied which would wet and coat at least a portion of the internal surfaces of the metal structure thereby providing oxidation protection. Ceramic coatings such as silicon dioxide, aluminum oxide, titanium oxide, chromium oxide, in any and all combinations and proportions would be suitable for this purpose. The thickness and composition of the ceramic coating has to be regulated since it will reinforce the porous structure and reduce abradability of the structure. Any artisan can determine the composition and thickness of the ceramic coating to balance the abradability and oxidation resistance requirements for any particular application.

A lower porosity coating than that produced through the use of a sintering operation only can be obtained by subjecting the sintered coated structure to a cold rolling or pressing process followed thereafter by an annealing operation. This approach could produce an abradable coating having a density of about 80 percent theoretical.

To increase the porosity of the porous structure, porous metal particles of uniform size can be used in place of the metal powders described above. The porous metal particles can be fabricated by agglomerating a fine metal powder or flake powder and sintering thereafter in a suitable atmosphere, depending on the particle material selected, to produce a high void friable sheet. The sheet can then be pulverized and screened to provide a selected size of porous particles which can be processd as described above.

It is also within the purview of this invention to sprinkle metal flakes of a material listed above onto a tacky binder layer rather than the metal powder of the material and then proceed as described above. This will produce a low density, porous metal coating having a greater tendency to crush than abrade since the flakes will substantially lie parallel to the surface of the substrate. This coating is particularly suited in areas where the debris generated from abrading may cause damage to surrounding parts. The flakes could vary in planar dimensions from about 25 microns × 25 microns to about 200 microns × 200 microns with a thickness of between about 1 micron and about 10 microns, and preferably a planar dimension about 100 micron × 100 micron with a thickness of about 5 microns would be desirous.

It has been experimentally found that the abradable coating prepared according to this invention, using nickel chromium alloy as the metal powder and a rubber based binder material, has an erosion resistance that is two times better than a commercially available abradable coating of Hastelloy X* fiber metal, an oxidation resistance that is seventeen times better and a thermal shock resistance that is four times better.

*Hastelloy X — A trademark of the Cabot Corporation for an alloy whose principal constituents are chromium, nickel, molybdenum and iron.

The following examples will serve to illustrate the concept of this invention.

EXAMPLE I

A 2-mil thick tacky layer of a rubber base adhesive (commercially available as Krylon from the Borden Chemical Co.) was sprayed onto a solid piece of Inconel 600** measuring 2 inches by 6 inches. A layer of Inconel 600 powder, measuring 150 to 250 Tyler mesh, was sprinkled onto the tacky binder layer and the excess powder thereon was removed by simply inverting the coated Inconel 600 sample and slightly shaking it. This produced a monolayer of the Inconel powder secured to the binder. A second binder application of the Krylon was applied over the first Inconel 600 powder layer followed thereafter by a second sprinkling of the Inconel 600 powder. The excess powder was again removed in the manner described above. The particles of the second metal powder layer tended to adhere to the particles of the first metal powder layer. Additional coats of the binder and particle material were applied until a thickness of 0.126 inches was obtained. The coated Inconel 600 sample was then pre-sintered in a dry hydrogen atmosphere (−40° F. dew point) of a belt furnace for 15 minutes at 1180° C. to decompose the plastic element of the Krylon binder, remove the carbon residue present in the binder and to initiate sintering. The pre-sintered sample was removed and placed in a dry hydrogen atmosphere (−40° F. dew point) of a belt furnace heated to 1250° C. and held thereat for one hour. This sintering operation was sufficient to grow strong bonds between the particles of the metal powders and between the particles and the Inconel 600 piece. An additional heat treatment in a nitrogen atmosphere at 1250° C. for one hour was performed to increase the oxidation resistance of the coating.

** Inconel 600 — A trademark of the International Nickel Corporation for an alloy whose major constituents are nickel, chromium and iron.

A commercially available nickel graphite* abradable coated sample and a fiber metal** abradable coated sample were tested along with the abradable coated sample of this example for abradability, crushability and erosion resistance characteristics.

* 75% nickel, 25% carbon (graphite) made according to General Electric Corporation Specification B50TF-52

** A Hastelloy—X fibrous mat material commercially described as "Feltmetal", a registered trademark of the Huyck Corp.

The abradability of the samples was measured as a depth of a groove obtained using a Taber Shear and Scratch Tester utilizing a 45° cone penetrator moving across the sample at 6 feet per minute under specified loads.

Crushability was measured with a Shore Durometer utilizing a Type A-2 calibration unit.

The erosion resistance was determined by impinging a 45 psig stream of argon through a 0.018 inch nozzle against the sample at various angles from a distance of 0.4 inch. A 27 micron $Al_2O_3$ powder was fed into the argon stream at a rate of 0.5 grams per minute and the erosion was determined as the ratio of the exposure time in seconds to pit depth in mils.

The results of the test are shown in Tables 1 through 3.

Table 1

| Load (grams) | Abradability (depth of groove) Nickel Graphite | Fiber Metal | Example 1 Sample |
|---|---|---|---|
| 250 | <0.001 inch | 0.001 inch | 0.002 inch |
| 500 | 0.001 inch | 0.004 inch | 0.004 inch |
| 1000 | 0.002 inch | 0.008 inch | 0.010 inch |

Table 2

| | Crushability Nickel Graphite | Fiber Metal | Example 1 Sample |
|---|---|---|---|
| Hardness No. | >100 | 98 | 95 |

Table 3

| Impingement angle | Erosion Resistance (ratio: exposure time (secs) pit depth (mils)) Nickel Graphite | Fiber Metal | Example 1 Sample |
|---|---|---|---|
| 20° | 32 | 15 | 27 |
| 45° | 14 | 7 | 14 |
| 90° | 16 | 10 | 14 |

EXAMPLE 2

Samples prepared as in Example 1 were surface treated with a silica-based cement coating comprising:

100 parts by weight fit (commercially available as No. 5210 from the Ferro Corporation);

40 parts by weight titanium dioxide;

3 parts by weight chromium oxide;

6 parts by weight green label clay (product of Ferro Corporation);

½ part by weight potassium nitride. 1250°

This silica-based composite was ball milled with alcohol for one week to produce a colloidally suspended mixture having no visible separation in a dilute solution. The samples prepared as in Example 1, were dipped into the suspension and then air dried at a temperature of 30° C. to remove the alcohol present therein. This dipping and drying process was repeated until the sample had gained 9% by weight. The fine particles of frit and oxide of this coating settled into pores of the porous metal structure during these dippings. The coated samples were then heated in a nitrogen atmosphere to 1250° C. and held thereat for two hours. At this temperature the coating became molten thus wetting a portion of the surface of the Inconel 600 solid piece and the bulk of the porous metal layer thereby producing a glassy oxide protective coating.

Samples prepared as in Example 1 and samples prepared with a silica-based coating as described above were exposed to air at an elevated temperature of 1600° F. After specified time intervals, the samples were weighed to ascertain their weight gain, such gain being directly related to the oxidation rate of the sample. The results of this test are shown in Table 4 and demonstrate that the oxidation resistance of a porous metal abradable seal can be increased by coating it with a ceramic type material.

Table 4

| Exposure Time (hours) | Oxidation Resistance Uncoated Sample Weight Gain % | Coated Sample Weight Gain % |
|---|---|---|
| 100 | 3.25% | 1.05% |
| 200 | 4.10% | 1.38% |
| 300 | 4.68% | 1.55% |
| 400 | 5.10% | 1.68% |

EXAMPLE 3

Samples were prepared as in Example 1 except that a flake powder was substituted for the regular-shaped powder used in Example 1. The flake powder was prepared by ball milling the powder particles used in Example 1 for a period of 24 hours to produce a flat-flake particle. The flake powder so formed was then screened to yield flakes having a Tyler mesh size of between 65 and 250. The flakes were sprinkled onto the tacky coated surfaces as in Example 1 and sintered thereafter in an identical manner. The flakes were substantially orientated parallel to the Inconel 600 sample surface producing a finished layered structure which tended to crush rather than abrade upon the application of a frictional surface force. Tests were performed on these samples and on commercially available abradable samples as described in Example 1 and the results are tabulated in Table 5 through Table 7.

Table 5

| Load (grams) | Abradability (depth of groove) Nickel Graphite | Fiber Metal | Example 3 Sample |
|---|---|---|---|
| 250 | <0.001 inch | 0.001 inch | 0.007 inch |
| 500 | 0.001 inch | 0.004 inch | 0.012 inch |
| 1000 | 0.002 inch | 0.008 inch | 0.021 inch |

Table 6

| | Crushability | | |
|---|---|---|---|
| | Nickel Graphite | Fiber Metal | Example 3 Sample |
| Hardness No. | >100 | 98 | 90 |

Table 7

| | Erosion Resistance (ratio of exposure time (secs) pit depth (mils) | | |
|---|---|---|---|
| Impingment angle | Nickel Graphite | Fiber Metal | Example 3 Sample |
| 20° | 32 | 15 | 15 |
| 45° | 14 | 7 | 8 |
| 90° | 16 | 10 | 8 |

EXAMPLE 4

Samples were prepared as in Example 1 except porous particles were used instead of the regular-shaped particles. A fine Hastelloy X powder, 325 Tyler mesh size and finer, was ball milled and then sintered in dry hydrogen to produce a high void friable sheet. The sheet was then pulverized and therafter screened to produce porous particles between about 60 and 150 Tyler mesh size. The particles were sprinkled onto a tacky binder layer as described in Example 1 and thereafter sintered in an identical manner. This produced a highly porous structure with excellent abradability characteristics. This structure was tested along with commercially available abradable structures as in Example 1 and the results obtained are shown in Table 8 through Table 10.

Table 8

| | Abradability (depth of groove) | | |
|---|---|---|---|
| Load (grams) | Nickel Graphite | Fiber Metal | Example 4 Sample |
| 250 | <0.001 inch | 0.001 inch | 0.023 inch |
| 500 | 0.001 inch | 0.004 inch | 0.030 inch |
| 1000 | 0.002 inch | 0.008 inch | 0.060 inch |

Table 9

| | Crushability | | |
|---|---|---|---|
| | Nickel Graphite | Fiber Metal | Example 4 Sample |
| Hardness No. | >100 | 98 | 88 |

Table 10

| | Erosion Resistance (ratio of exposure time (secs) pit depth (mils) | | |
|---|---|---|---|
| Impingement angle | Nickel Graphite | Fiber Metal | Example 4 Sample |
| 20° | 32 | 15 | 15 |
| 45° | 14 | 7 | 7 |
| 90° | 16 | 10 | 8 |

Example 5

A sample abradable coated plate, measuring 2 inches by 2 inches, was prepared as in Example 1 and a second sample plate, measuring 2 inches by 2 inches was prepared as in Example 2. A third sample plate of commercially available abradable seal known as *FM 503, measuring 2 inches by 2 inches was obtained from the Huyck Corporaton. The three sample plates were subjected to a cutting test in which a 68 tooth, 7.25 inch diameter, 0.27 inch wide, Inconel 600 plate was used to cut scars into each of the samples. With the plate rotating at 4000 rpm and each sample piece being passed under the plate at a speed of 1.25 inches per minute, various scar depths were imparted into each sample. The horse power required to make each scar was recorded and is shown in Table 11. These results show that the abradability characteristics of the porous coatings prepared in accordance with our invention are better than the commercially available abradable seal.

Table 11

| | Power Required to Scar Abradable Materials (Horse Power) | | |
|---|---|---|---|
| Scar Depths Inches | Example 1 Sample | Example 2 Sample | *FM-503 Sample |
| 0.01 | 0.01 | 0.10 | 0.31 |
| 0.02 | 0.015 | 0.43 | 0.79 |

*FM-503 - fibrous mat material commercially described as "Feltmetal", a registered trademark of the Huyck Corporaton.

What is claimed is:

1. A process for producing a metal porous abradable structure comprising the steps:
   a. depositing a coating of a binder material onto a substrate to produce a tacky surface layer sufficient to secure metal particles sprinkled thereon against the force of gravity when said layer is inverted,
   b. depositing metal particles onto said tacky binder layer to produce a metallic monolayer thereon;
   c. repeating the steps (a) and (b) at least once to produce a multilayer deposit of particles secured in the binder; and
   d. heating said deposited multilayer in the as-deposited state at a temperature and for a time period sufficient to substantially remove the binder and to sinter the metallic particles together thereby forming a porous abradable structure.

2. The process of claim 1 wherein step (c) the metallic particles are securely bonded to the substrate.

3. The process of claim 1 wherein in step (d) the metallic deposited multilayer is heated in the as-deposited state to a temperature and for a time period sufficient to remove the binder and thereafter heated again to a higher temperature and for a time period sufficient to substantially complete the sintering of the metallic particles.

4. The process of claim 3 wherein after the removal of the binder in step (d) the porous structure is cleaned and dimensionally sized prior to heating it to a temperature and for a time period sufficient to substantially complete the sintering for the metallic particles.

5. The process of claim 1 wherein after (d) the following steps are added:
   e. depositing at least one ceramic layer on said porous structure sufficient to retard oxidation while not excessive to substantially affect the abradability characteristics of the porous structure; and
   f. heating said ceramic coated structure to a temperature necessary for substantially wetting the internal surface of the porous structure.

6. The process of claim 1 wherein the metal particles are selected from at least one of the groups consisting of nickel, chromium and their alloys.

7. The process of claim 5 wherein the metal particles are selected from at least one of the groups consisting of nickel, chromium and their alloys.

8. The process of claim 7 wherein said ceramic material is selected from at least one of the groups consisting of the oxides of silicon, aluminum, titanium and chromium.

9. The process of claim 1 wherein said particles are flake shaped.

10. The process of claim 1 wherein said particles are porous particles.

* * * * *

UNITED STATES PATENT OFFICE

CERTIFICATE OF CORRECTION

Patent No. 4,049,428 Dated September 20,1977

Inventor(s) Raymond John Elbert, Ernest Gilbert Farrier

It is certified that error appears in the above-identified patent and that said Letters Patent are hereby corrected as shown below:

Column 5, line 63 should read as follows:

--100 parts by weight frit (commercially available as No.--

Column 6, line 1 should read as follows:

--1/8 part by weight potassium nitride.--

Signed and Sealed this

*Tenth* Day of *January 1978*

[SEAL]

*Attest:*

RUTH C. MASON
*Attesting Officer*

LUTRELLE F. PARKER
*Acting Commissioner of Patents and Trademarks*